United States Patent [19]

Tomioka et al.

[11] 4,034,187

[45] July 5, 1977

[54] THERMAL PRINTING HEAD

[75] Inventors: Tatsuyuki Tomioka, Hirakata; Noboru Yukami, Kawanishi; Yoshi Hamaguchi; Kiyoharu Yamashita, both of Hirakata, all of Japan

[73] Assignee: Matsushita Electric Industrial Co., Ltd., Kadoma, Japan

[22] Filed: Sept. 15, 1975

[21] Appl. No.: 613,463

[30] Foreign Application Priority Data

Sept. 18, 1974 Japan ..... 49-108240
Oct. 17, 1974 Japan ..... 49-120131

[52] U.S. Cl. ..... 219/216; 346/76 R
[51] Int. Cl.² ..... H05B 1/00
[58] Field of Search ..... 219/216, 543; 357/5–6, 357/28; 29/576, 577; 346/76

[56] References Cited

UNITED STATES PATENTS

| | | | |
|---|---|---|---|
| 3,290,753 | 12/1966 | Cheng | 29/576 E |
| 3,416,224 | 12/1968 | Armstrong et al. | 29/577 X |
| 3,515,850 | 6/1970 | Cady, Jr. | 219/216 |

*Primary Examiner*—C. L. Albritton
*Attorney, Agent, or Firm*—Wenderoth, Lind & Ponack

[57] ABSTRACT

A thermal printing head of the planar type which comprises a silicon substrate, a plurality of heat-generating elements provided in the silicon substrate and a heat-insulation layer of silicon dioxide which is provided around each heat-generating element. The heat-insulation layer of silicon dioxide has an excellent heat-insulation characteristic, so that heat which is generated from the heat-generating elements is prevented from flowing to neighboring heat-generating elements whereby distinct patterns can be printed on a thermo-sensitive paper.

1 Claim, 10 Drawing Figures

THERMAL PRINTING HEAD

BACKGROUND OF THE INVENTION

This invention relates to a thermal printing head for use in a device which is adapted to print information on thermosensitive paper by means of thermal energy.

Various types of thermosensitive papers which produce colors in response to the application of thermal energy are now available on the market. Thermal printing heads of the kind in which heat is generated by the concentrated flow of current through a resistor portion have been developed and are now available on the market. Thermal printing heads of this kind can be broadly classified into three types the silicon planar type, the thin film type and the thick film type. Among the three types of thermal printing heads, this invention particularly pertains to a thermal printing head of the silicon planar type.

Conventional thermal printing heads of the silicon planar type have had a plurality of heat-generating elements arranged in a matrix form or in a line, which heat-generating elements are separated from each other by means of moats provided therearound so as to avoid blurring of printing patterns due to heat leaking between the neighboring elements thereby forming a plurality of mesas which are separated by air isolating space therebetween.

However, with a thermal head of this kind, there has been a problem that during repeated heating and cooling cycles over a long period of time, fragments of thermosensitive coloring materials and fibers of paper gradually accumulate in the moats between mesas, and finally adhere on the surfaces of mesas, and thus prevent the contact of the mesa surfaces and the thermosensitive paper, with the result that not only does the intensity of the printed patterns become less but also the temperature of the mesa surfaces becomes excessively high causing shortening of the life of the thermal printing head.

Furthermore, there has been a problem that when the mesa surfaces are in contact with the thermosensitive paper, mesa edges are subjected to stress concentration and during repeated contact of the mesa surfaces and the thermosensitive paper, the mesa edges are broken or the mesas themselves are exfoliated from the ceramic substrate.

In addition to the above-described problems, there has been a problem that since the thickness of the silicon chip forming the thermal printing head is thin being on the order of about 50 $\mu$m, the silicon wafer in which is formed the mesa moats about 30 $\mu$m depth is easy to crack, so that it is almost impossible to form mesa moats on the wafer alone, for the reason that the mesa grooves are formed on the silicon chip which is bonded to and electrically insulating substrate such as ceramic whereby it is not suitable for mass production.

The problems described above could be solved if the head surface to be brought into contact with the thermosensitive paper was flat and had no moats; however, with such a structure, the printing pattern is blurred due to heat leaking between neighboring heat-generating elements.

SUMMARY OF THE INVENTION

The aforementioned problems have been completely solved by the thermal printing head of this invention.

The first object of this invention is to provide a new and improved thermal printing head which is capable of avoiding blurring of printing patterns although the contact surface of the head is almost flat and has no moats.

The second object of this invention is to provide a new and improved thermal printing head in which the thickness of the printing pattern is kept in the initial state for a long time.

The third object of this invention is to provide a new and improved thermal printing head which can be used for a long time without deterioration of the printing characteristics thereof.

A fourth object of this invention is to provide a new and improved thermal printing head which is suitable for mass production.

BRIEF DESCRIPTION OF THE DRAWINGS

Other objects and advantageous features of this invention will become apparent from the following explanations taken in connection with some embodiments thereof, by referring to the accompany drawings, in which.

DESCRIPTION OF THE PREFERRED EMBODIMENTS

Figure 1:
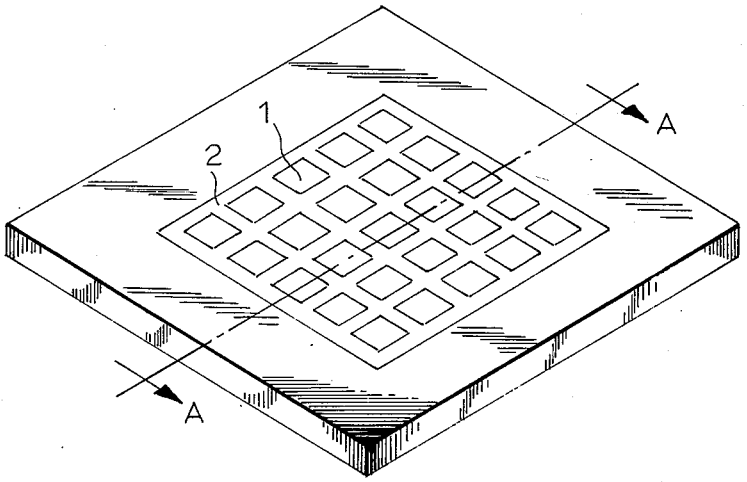
FIG. 1 is a perspective view illustrating an embodiment of the basic concept of this invention.
Figure 2:
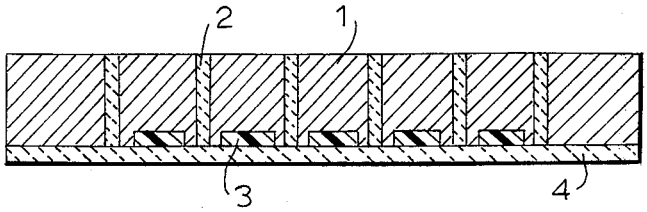
FIG. 2 is a cross-sectional view taken along the line A—A of FIG. 1.

FIGS. 1 and 2 diagramatically illustrate an embodiment of the basic concept of this invention.

FIG. 1 is a perspective view illustrating heat-generating elements arranged in a matrix form. In FIG. 1, reference numeral 1 designates heat-generating elements; a heat-resistive material 2 which has electrical- and heat-insulating properties, separates the neighboring heat-generating elements 1 from each other. FIG. 2 is a cross-sectional view taken along the line A—A of FIG. 1.

In FIG. 2, the neighboring heat-generating elements 1 are thermally separated from each other by the heat-resistive material 2. Heat-resistive flat element 3 is provided in each heat generating element 1 on the surface away from the printing surface, and oxidized film is placed on the surface of the elements over flat elements 3. A plurality of metalic electrodes (not shown in this FIGURE) are mounted on both sides of each heat-generating element 1 and are connected to an electrical-insulation substrate such as ceramic (not shown in this FIGURE) by a flip-chip method or a beam-lead bonding method. The space defined by the electrical-insulation substrate and the silicon substrate is filled with polyamid resin, epoxy resin and the like.

FIGS. 3 to 9 show successive steps for the manufacture of the thermal printing head according to this invention.

Figure 3:
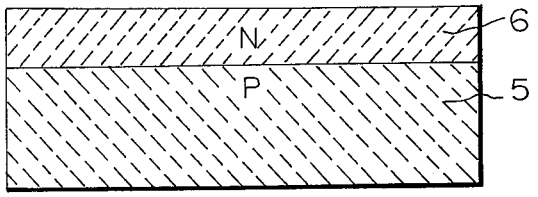
FIG. 3 is a fragmentary cross-sectional view of a wafer with an a p-type epitaxial layer formed on an n-type silicon substrate.
Figure 4:
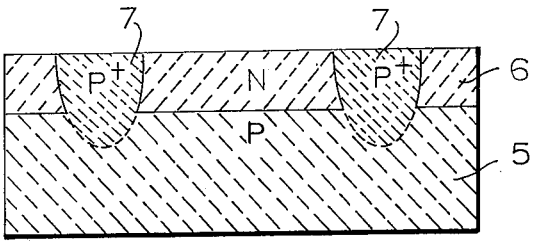
FIG. 4 is a fragmentary cross-sectional view of the wafer of FIG. 3 with a $p^+$-type diffusion layer formed by an ordinary Boron diffusion technique.

Referring to FIG. 3, reference numeral 5 designates a p-type silicon substrate having a specific resistivity of about 1 Ω cm and a thickness of about 50 μ m, Numeral 6 indicates an n-type epitaxial layer having a specific resistivity of about 1 Ω cm and a thickness of about 50 μ m, and which is formed on the p-type silicon substrate 5. In addition to the structure of FIG. 3, $p^+$-type diffusion portions 7, passing through the n-type epitaxial layer 6, as shown in FIG. 4 are formed by an ordinary Boron diffusion technique. Sheet resistance of the $p^+$-type diffusion portions 7 is about 2Ω/ . If the sheet resistance of the $p^+$-type diffusion portion 7 is very much higher than the value of 2Ω/ , there occurs a problem that the silicon wafer is warped in an oxidization step which is performed after the step of changing the $p^+$-type diffusion portion to a porous silicon layer as described hereinafter.

Figure 5:
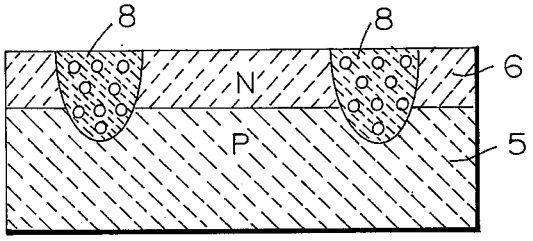
FIG. 5 is a fragmentary cross-sectional view of the wafer of FIG. 4 in which the $p^+$-type diffusion layer is changed to a porous silicon layer.
Figure 6:
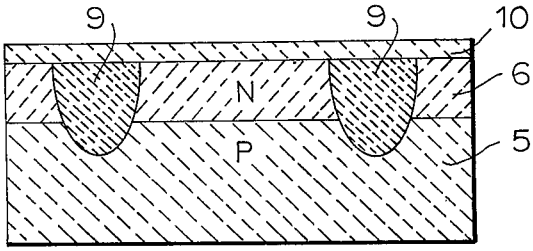
FIG. 6 is a fragmentary cross-sectional view of the wafer of FIG. 5 in which the porous silicon layer is changed to a silicon dioxide layer and an oxidized film is formed on the n-type epitaxial layer.

Then, by immersing the p-type silicon substrate 5 as an anode and a Platinum plate as a cathode a hydrofluoric acid solution, and creasing an electrical current with a current density of about 100mA/cm² to flow therebetween, an anodic reaction takes place, and thus, as shown in FIG. 5 the $p^+$-type diffusion portions 7 are changed to porous silicon portions 8 with about a 50μm depth. Moreover, as shown in FIG. 6 the porous silicon portions 8 are changed to a silicon dioxide layer 9 by oxidizing them at a temperature of 1000° C. in wet oxygen atmosphere and, at the same time, a thermally-oxidized film 10 is formed on the n-type epitaxial layer 6. The oxidation rate of porous silicon is higher than that of single crystal silicon.

Figure 7:
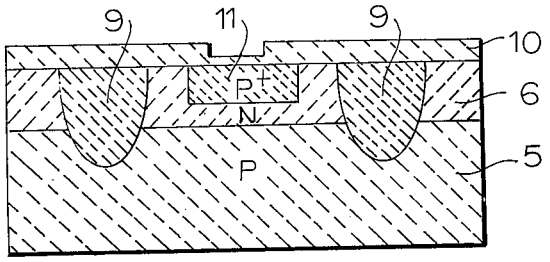
FIG. 7 is a fragmentary cross-sectional view of the wafer of FIG. 6 with a $p^+$-type diffusion layer.

Thereafter, as shown in FIG. 7, a $p^+$-type diffusion layer elements 11 are each formed by opening a window in the thermally-oxidized film 10 at a domain surrounded by the silicon dioxide layers 9, the $p^+$-type diffusion elements 11 acting as heat-generating resistive elements.

Figure 8:
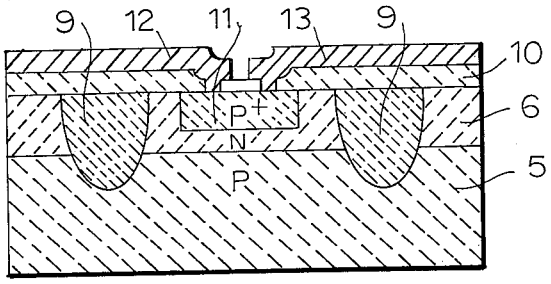
FIG. 8 is a fragmentary cross-sectional view of the wafer of FIG. 7 with a pair of metallic electrodes thereon.

Then, metallic electrodes 12 and 13 are provided on the both side of the $p^+$-type diffusion layer elements (heat-generating resistive layer) 11 leaving a window as shown in FIG. 8.

Figure 9:
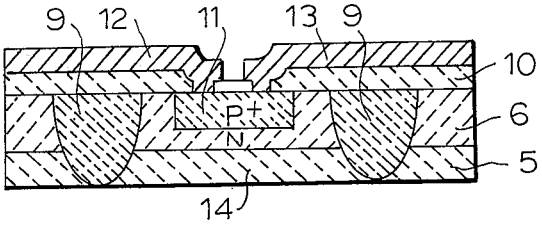
FIG. 9 is a fragmentary cross-sectional view illustrating a further embodiment of this invention.

Furthermore, by lapping and etching the back surface of the p-type silicon substrate 5 as far as vicinity of the deepest portion of the silicon dioxide portions 9, a silicon wafer about 50 μ m thick is obtained as shown in FIG. 9.

The domain surrounded by the silicon dioxide portion 9 acts as one of the heat-generating elements, the heat-generating resistive layer element 11 lying in the domain. The etched surface 14 which is flat, is the one which contacts the thermosensitive paper.

In the thermal printing head of this invention having the structure described above, when voltage is applied across the electrodes 12 and 13, a concentrated flow of current passes through the heat-generating resistive layer element 11 whereby it generates sufficient heat to produce a color on a thermosensitive paper. The thermal conductivity of silicon dioxide is 1/40that of silicon single crystal, so that flow of heat generated from the heat-generating resistive layer element 11 is blocked by silicon dioxide portion 9 whereby leakage of heat between neighboring heat-generating elements is very small. Therefore, the silicon dioxide layer act as heat-isolation means for blocking heat so that it does not flow heat to another neighboring heat-generating element.

Figure 10:
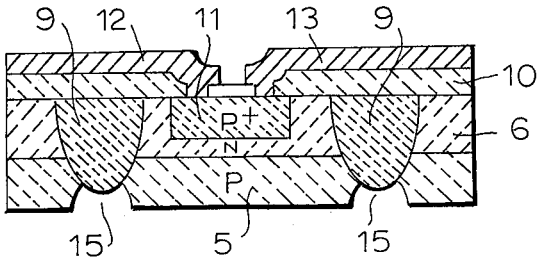
FIG. 10 is a fragmentary cross-sectional view showing still an another embodiment of this invention.

FIG. 10 is a cross-sectional view illustrating the wafer according to another embodiment of this invention. In this embodiment, very shallow grooves 15 are provided in the structure shown in FIG. 9 so as to prevent more completely leaking of heat from between neighboring heat-generating elements. The steps for making this wafer can be almost the same as those shown in FIGS. 3–9. The grooves 15 are provided by selectively etching the portions of the etched surface 14, which correspond to the silicon dioxide portions 9.

In, in the two embodiments of this invention described above, the $p^+$-type diffusion layer element 11 is used as the heat-generating resistive layer. However, by forming a transistor instead of a $p^+$-type diffusion layer element, the power dissipation of the transistor can be used for generating the heat.

Furthermore, the $p^+$-type diffusion portions 7 are not always necessary to obtain the porous silicon portions Such porous silicon portions can also be obtained directly by irradiating light on the n-type domain of the silicon wafer which is partially masked with a $Si_3N_4$ film while the anodic reaction mentioned above is taking place. Moreover, in those two embodiments of this invention, the etched side of the silicon substrate 14 is used as the surface which is brought into contact with a thermosensitive paper, but also the other side having electrodes is usable as the contact surface.

In addition, not only the heating element but also any other circuit can be proviced on the same chip.

As will be apparent from the foregoing explanation this invention is advantageous over the conventional thermal printing head in that it has excellent suitability for mass production and has a long life, and moreover, it provides distinct printing patterns.

The printing head thus has a high industrial value.

What we claim is:

1. A thermal printing head of the silicon planar type which comprises a silicon substrate having a generally flat substantially unbroken surface for being brought into contact with a thermosensitive paper;

a plurality of heat-generating layer elements which are provided in the silicon substrate, each heat-generating layer having an electrical resistivity;

heat-insulation portions of silicon dioxide extending through the thickness of the substrate around each heat-generating layer element whereby the domains surrounded by the heat-insulation portions constitute heat-generating elements, the heat-insulation portions preventing heat which is generated from the heat-generating elements; and a plurality of electrodes connected to the heat-generating elements for energizing them.

* * * * *